US006476786B1

(12) United States Patent
Miyachi

(10) Patent No.: US 6,476,786 B1
(45) Date of Patent: Nov. 5, 2002

(54) LIQUID CRYSTAL DISPLAY DEVICE CAPABLE OF REDUCING AFTERIMAGE ATTRIBUTED TO CHANGE IN DIELECTRIC CONSTANT AT TIME OF RESPONSE OF LIQUID CRYSTALS

(75) Inventor: Koichi Miyachi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 129 days.

(21) Appl. No.: 09/594,337

(22) Filed: Jun. 15, 2000

(30) Foreign Application Priority Data

Jun. 15, 1999 (JP) ..... 11-168174

(51) Int. Cl.[7] ..... G09G 3/36
(52) U.S. Cl. ..... 345/90; 345/92
(58) Field of Search ..... 345/87, 90, 92, 345/93, 205, 206; 349/42, 48, 45, 46

(56) References Cited

U.S. PATENT DOCUMENTS 5,218,464 A * 6/1993 Hiroki et al. ..... 359/59
5,903,249 A * 5/1999 Koyama et al. ..... 345/92
5,952,989 A * 9/1999 Koyama ..... 345/92
5,959,599 A * 9/1999 Hirakata ..... 345/92
6,297,518 B1 * 10/2001 Zhang ..... 349/43

FOREIGN PATENT DOCUMENTS

JP 8-211405 8/1996
JP 9-114421 5/1997

* cited by examiner

*Primary Examiner*—Dennis-Doon Chow
(74) *Attorney, Agent, or Firm*—Dike, Bronstein, Roberts & Cushman IP group Edwards & Angell, LLP; David G. Colin; David A. Tucker

(57) ABSTRACT

There is provided a liquid crystal display device capable of displaying every frame an image that is not influenced by the previous frame at all by removing an afterimage attributed to a change in dielectric constant at the time of response of liquid crystals. A scanning line GL1 is made to have a voltage of +15 V so as to turn on first and third TFT elements 1 and 3 constructed of an n-type MOS transistor and turn off a second TFT element 2 constructed of a p-type MOS transistor. A signal voltage Vs is applied to a memory capacitance Cm via the first TFT element 1, charging the memory capacitance Cm up to the signal. voltage Vs. Simultaneously with this operation, electric charges of a pixel capacitance Cp are discharged via the third TFT element 3. The other scanning lines GL2, GL3, . . . all have a voltage of −15 V, and the second TFT element 2 is turned on, consequently moving the electric charges accumulated in the memory capacitance Cm to the pixel capacitance Cp and varying the alignment state of the liquid crystals according to a change in voltage.

18 Claims, 13 Drawing Sheets

LIQUID CRYSTAL DISPLAY DEVICE CAPABLE OF REDUCING AFTERIMAGE ATTRIBUTED TO CHANGE IN DIELECTRIC CONSTANT AT TIME OF RESPONSE OF LIQUID CRYSTALS

BACKGROUND OF THE INVENTION

The present invention relates to an active matrix type liquid crystal display device.

Conventionally, there has been an active matrix type liquid crystal display device shown in FIG. 13. In this liquid crystal display device, a plurality of scanning lines GL1, GL2, . . . and a plurality of signal lines SL1, are arranged so as to intersect each other, and a pixel electrode 4 having a pixel capacitance (equal to liquid crystal capacitance) Cp and a TFT (Thin Film Transistor) element 51 are provided at each intersection of the scanning lines GL1, GL2, . . . and the signal lines SL1, . . . If, for example, the scanning line GL1 comes to have a high electric potential, then the TFT element 51 whose gate electrode is connected to the scanning line GL1 is put in an on (conductive) state to apply a specified signal voltage from the signal line SL1 to a pixel capacitance Cp. Subsequently, if the scanning line GL1 comes to have a low potential, then the TFT element 51 is put in an off (non-conductive) state. The pixel capacitance Cp can be regarded as a capacitor, and therefore, the accumulated electric charges are kept retained to allow the liquid crystals to retain a specified alignment state. By executing this operation on all the scanning lines GL1, GL2, . . . during one frame, a video image of one screen can be produced.

Active matrix type liquid crystal display devices of this kind are widely used as the displays of television screens and word processors.

However, the aforementioned conventional active matrix type liquid crystal display device has the problems as follows.

The liquid crystals to which a voltage is applied have a variety of alignment states depending on the signal conditions of the previous frame. Therefore, the pixel capacitance Cp, which is a capacitor provided by both electrodes that interposes liquid crystals between them, is able to have various capacitances depending on the alignment conditions of the liquid crystals. That is, if the pixel capacitance Cp comprised of the liquid crystal capacitance is charged with a specified voltage determined in accordance with image data, then the quantity of electric charges varies depending on the alignment conditions of the liquid crystals during charging even with an identical signal (voltage).

A reduction in image quality due to this will be described on the basis of a normally-white active matrix type liquid crystal display device that employs twisted nematic (abbreviated to TN hereinafter) liquid crystals. FIG. 14 shows an application voltage-to-transmittance characteristic curve of TN liquid crystals, while FIG. 15 shows an application voltage-to-dielectric constant characteristic curve.

For example, it is assumed that a pixel that has continued the display of white color is made to suddenly display black color. In this stage, the voltage application (charging) of the first frame of the display of black color is effected on the alignment state of the liquid crystals that are displaying white color. As shown in FIGS. 14 and 15, the dielectric constant of the liquid crystals that are displaying white color is smaller than the dielectric constant of the liquid crystals that are displaying black color. Therefore, if a signal voltage of the display of black color is applied to the liquid crystals in the state in which white color is displayed, then the dielectric constant increases according to the response of the liquid crystals. Accordingly, the quantity of electric charges is retained even when the response of the liquid crystals is sufficiently fast, and consequently, the voltage becomes small in the next frame.

As described above, the application voltage runs short when the black color is to be displayed, and consequently, as shown in FIG. 14, the display of the voltage before the achievement of the voltage of the display of black color, i.e., gray color is disadvantageously displayed. When displaying a motion picture, this phenomenon is perceived as an afterimage by the human eye. FIG. 16 shows a change in the application voltage of the liquid crystals when the display of white color is changed to the display of black color, while FIG. 17 shows a change in transmittance. As a result, a step-like response waveform as shown in FIG. 17 occurs, proving the existence of an afterimage.

In order to improve this phenomenon, an auxiliary capacitance is sometimes provided parallel with the liquid crystal capacitance. However, there is a certain change in the capacitance of the liquid crystals at the time of response according to the aforementioned theory, and therefore, the afterimage cannot completely be removed. It can also be considered to reduce the effect of change in the capacitance of the liquid crystals to an ignorable extent by providing a very large auxiliary capacitance. In this case, a reduction in charging rate due to an increase in the electric load and a reduction in the aperture rate of pixel due to the large auxiliary capacitance occur, and therefore, the other demerits are inappropriately large. Therefore, the liquid crystal capacitance and the auxiliary capacitance are generally set to values that are roughly equal to each other, and eventually, the aforementioned afterimage exists.

SUMMARY OF THE INVENTION

Accordingly, the object of the present invention is to reduce the afterimage attributed to the change in the dielectric constant (voltage) at the time of response of liquid crystals.

In order to solve the aforementioned problems, the present invention provides an active matrix type liquid crystal display device comprising:

a TFT substrate on which a plurality of scanning lines and a plurality of signal lines are arranged so as to intersect each other and which has a pixel electrode, a memory capacitance and first, second and third TFT elements provided at each intersection of the scanning lines and the signal lines;

an opposite substrate having an opposite electrode; and a liquid crystal layer held between the TFT substrate and the opposite substrate, gate electrodes of the first, second and third TFT elements being connected to the scanning lines, the first TFT element controlled to determine whether or not electric charges are supplied from the signal line to the memory capacitance, the second TFT element controlled to determine whether or not the electric charges stored in the memory capacitance are supplied to the pixel electrode, the third TFT element controlled to determine whether or not the pixel electrode is connected to a wiring line of a specified voltage, and the first, second and third TFT elements being comprised of one n-type MOS element and two p-type MOS elements or constructed of one p-type MOS element and two n-type MOS elements.

An operation when selecting a certain scanning line will now be considered.

In this case, it is assumed that each of the first and third TFT elements is the n-type MOS transistor and the second TFT element is the p-type MOS transistor. The selection of a scanning line is executed by providing a high potential on the scanning line.

If the scanning line is selected with the provision of a high potential, then the first and third TFT elements, which are each constructed of the n-type MOS transistor, are turned on, while the second TFT element, which is the p-type MOS transistor, is turned off. Consequently, the signal voltage from the signal line is applied through the first TFT element to the memory capacitance. The memory capacitance is provided by, for example, electrodes, an insulating film and so on. Therefore, no change in capacitance occurs dissimilarly to the liquid crystals, and this memory capacitance can be charged with a very strictly specified quantity of electric charges with respect to the signal voltage. Simultaneously with this, the pixel electrode is connected to the wiring line of the specified potential through the third TFT element put in the on state, and therefore, the electric charges of the liquid crystal capacitance-are discharged.

On the other hand, the other scanning lines are kept at the low potential in this stage. Then, the first and third TFT elements connected to the other scanning lines are in the off state, while the second TFT element is in the on state. Therefore, the movement of electric charges from the memory capacitance through the second TFT element to the pixel electrode (liquid crystal capacitance) occurs and continues until the liquid crystal response is completed.

The scanning lines are sequentially selected, and the other scanning lines are made to have a low potential.

Through this operation, the liquid crystal capacitance before the charging has already been discharged by the third TFT element, and the dielectric constant has been constant. A specified quantity of electric charges are supplied through the second TFT element to the liquid crystal capacitance of the specified dielectric constant from the memory capacitance of which the capacitance does not change.

Therefore, according to this active matrix type liquid crystal display device, a specified voltage that does not depend on the data of the previous frame can be applied to the liquid crystals even in the case of a motion picture of which the video signal frequently changes, and therefore, the afterimage can be significantly reduced.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
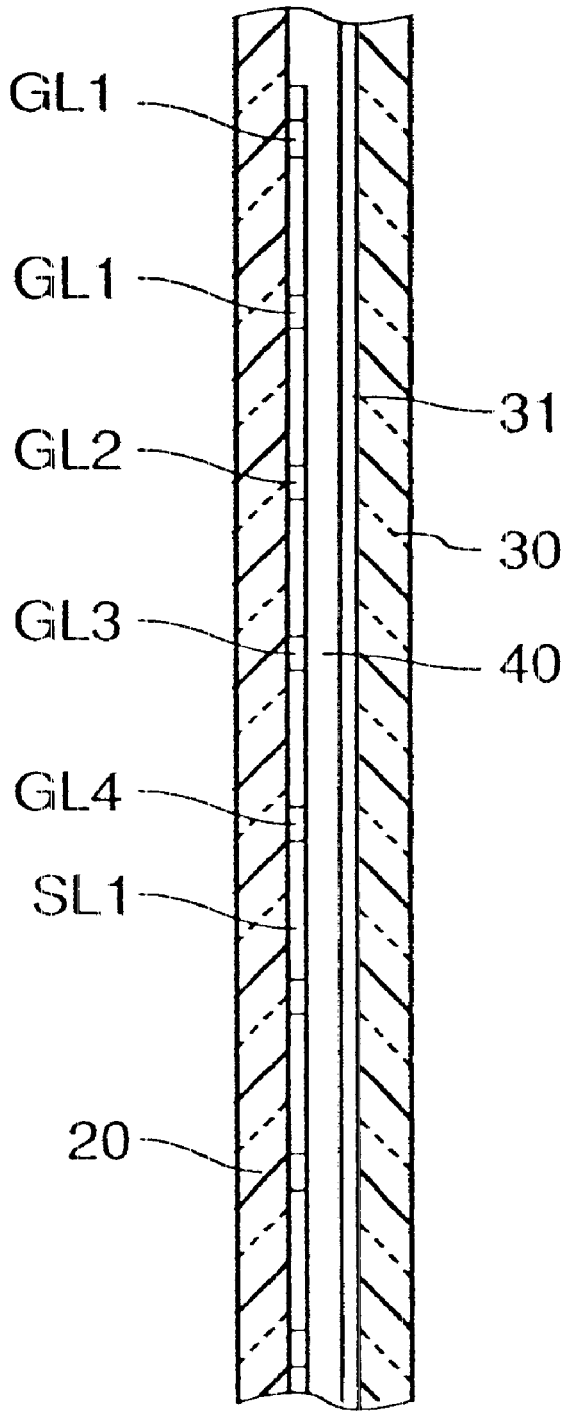
FIG. 1 is a sectional view of a liquid crystal display device according to a first embodiment of the present invention.

The present invention will be described in detail below on the basis of the embodiments thereof shown in the drawings.

First Embodiment

As shown in FIG. 1, a TFT substrate 20 is formed of quartz glass, and signal lines SL1, . . . and scanning lines GL1, GL2, GL3, . . . are provided in mutually intersecting directions on this TFT substrate 20. An opposite electrode 31 that is a transparent electrode made of ITO (Indium Tin Oxide) is formed on an opposite substrate 30 made of a glass substrate, and a black matrix for obstructing light of the portion that contributes nothing to the display and a color filter are formed although not shown. A liquid crystal layer 40 is held between the TFT substrate 20 and the opposite substrate 30. This liquid crystal layer 40 is comprised of twisted nematic (TN) mode liquid crystals used generally.

Figure 2:
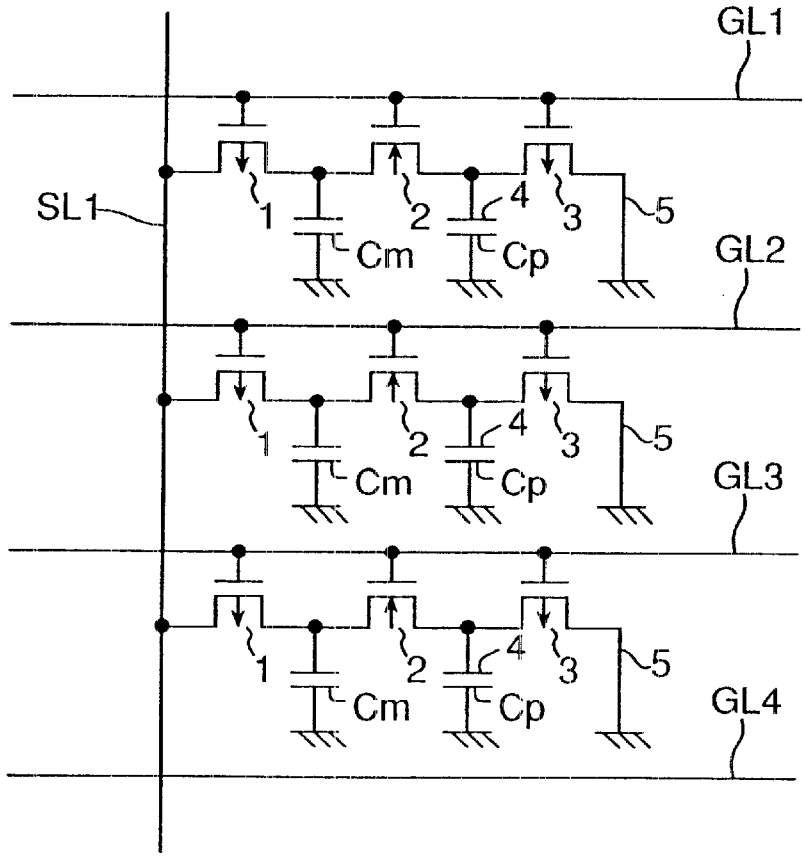
FIG. 2 is an equivalent circuit of the first embodiment.

As shown in FIG. 2, at the intersections of the signal lines SL1, . . . and the scanning lines GL1, GL2, GL3, . . . on the TFT substrate 20 (see FIG. 1), there are formed first, second and third TFT elements 1, 2 and 3 and a memory capacitance Cm as well as a pixel electrode 4 that is a liquid crystal electrode having a pixel capacitance (equal to the liquid crystal capacitance) Cp being part of the liquid crystal layer 40 (see FIG. 1). The first, second and third TFT elements are formed of high-temperature polysilicon. The memory capacitance Cm is provided by an insulating film. The pixel electrode 4 is formed of ITO.

The first and third TFT elements 1 and 3 of each pixel located at the intersections of the signal lines SL1, . . . and the scanning lines GL1, GL2, GL3, . . . are each constructed of an enhancement type n-type MOS (Metal Oxide Semiconductor) transistor, while the second TFT element 2 is constructed of an enhancement p-type MOS transistor.

The gate electrodes of the first, second and third TFT elements 1, 2 and 3 located on an identical row are connected to the identical scanning line GL1, GL2, respectively.

The first TFT element 1 is connected across the signal lines SL1, . . . and the memory capacitance Cm, and the first TFT element 1 determines whether or not electric charges are supplied from the signal line SL1 to the memory capacitance Cm. Although there are provided a plurality of signal lines SL1, . . ., only the signal line SL1 of the first column is shown in FIG. 2. The second TFT element 2 is connected across the memory capacitance Cm and the pixel electrode 4 of the pixel capacitance Cp, and this second TFT element 2 determines whether or not electric charges accumulated in the memory capacitance Cm are supplied to the pixel electrode 4. The pixel electrode 4 is connected to a wiring line 5 that has an electric potential equal to that of the opposite electrode 31 (see FIG. 1) by way of the third TFT element 3, and this third TFT element 3 controls whether or not the electric charges in the pixel electrode 4 are to be discharged.

Figure 14:
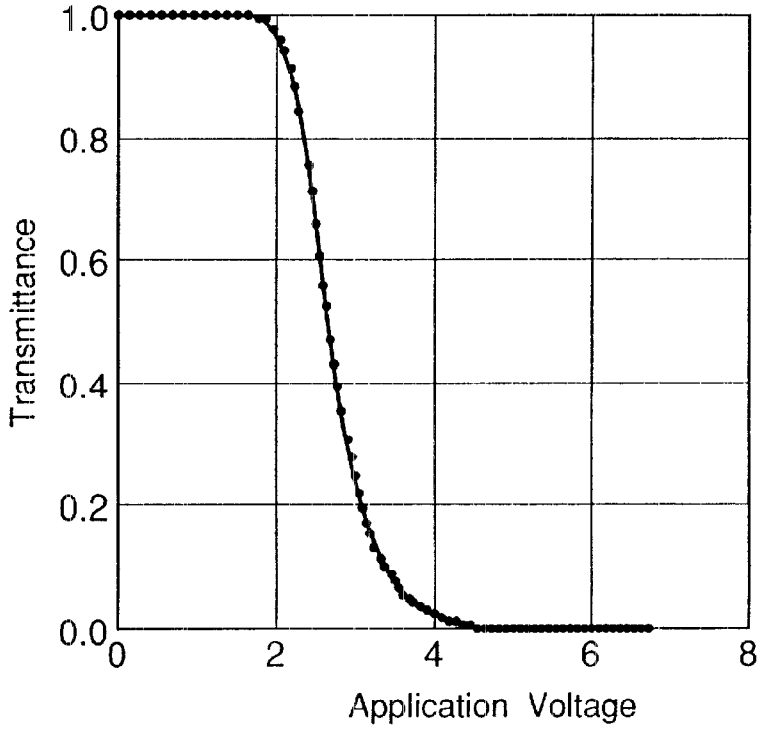
Fig.14 PRIOR ART
FIG. 14 is a graph showing an application voltage-to-transmittance characteristic of TN liquid crystals.
Figure 15:
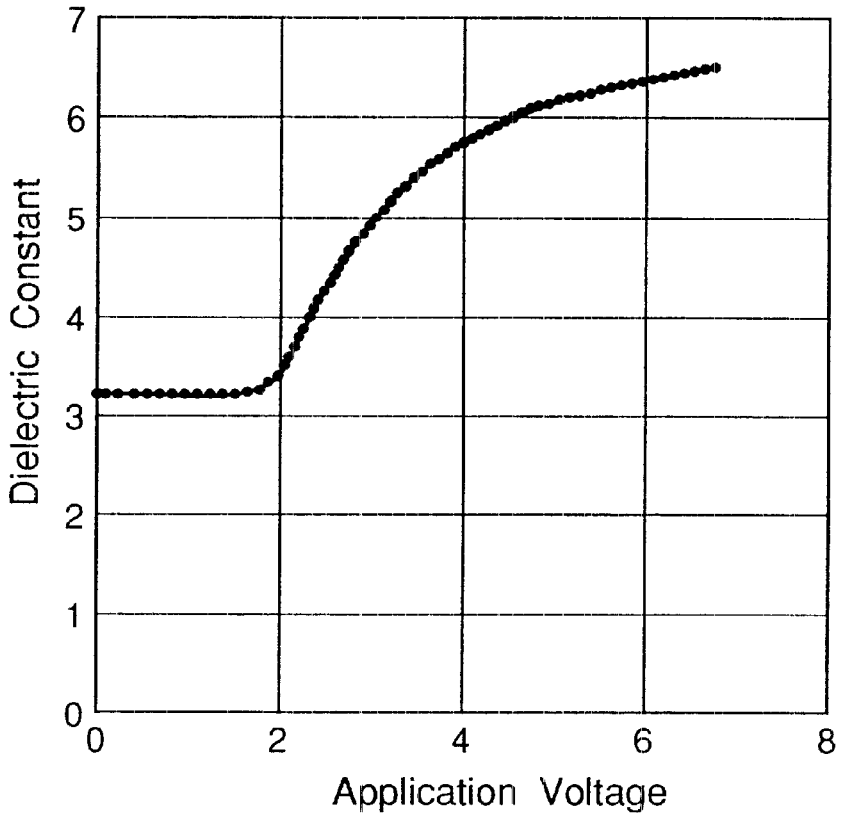
Fig.15 PRIOR ART
FIG. 15 is a graph showing an application voltage-to-dielectric constant characteristic of TN liquid crystals.

The memory capacitance Cm was designed to have a capacitance of 0.5 pF. The pixel capacitance (liquid crystal capacitance) Cp at the time of the display of white color was 0.065 pF, while the pixel capacitance (liquid crystal capacitance) Cp at the time of the display of black color was 0.12 pF. The basic characteristics of the liquid crystals are as shown in FIGS. 14 and 15. The signal voltage was determined on the basis of the fact that electric charges are retained, according to the following equation:

$$Cm \times Vs = (Cm + Cp) \times Vlc$$

where Cm: memory capacitance,

Vs: signal voltage,

Cp: pixel capacitance (liquid crystal capacitance), and

Vlc: liquid crystal application voltage.

For example, in the case of the display of white and black colors, the signal voltage was set as follows.

| | Display of White Color | Display of Black Color |
|---|---|---|
| signal Voltage Vs | 1.98 V | 5.85 V |
| liquid crystal application voltage Vlc | 1.75 V | 4.72 V |

The driving sequence is as follows. When applying the signal voltage Vs to the specified memory capacitance Cm, for example, the scanning line GL1 of the first row was set to a voltage of +15 V. In this stage, the first and third TFT elements 1 and 3 are put in the on (conductive) state, while the second TFT element 2 is put in the off (non-conductive) state.

Consequently, the signal voltage Vs is applied from the signal line SL1 to the memory capacitance Cm via the first TFT element 1, and the memory capacitance Cm is charged up to the signal voltage Vs. Simultaneously with this, the electric charges of the pixel capacitance (liquid crystal capacitance) Cp are discharged through the third TFT element 3, and the electric charges in the pixel capacitance Cp are discharged until the electric potential of the-pixel electrode (liquid crystal electrode) 4 becomes equal to the electric potential of the opposite electrode 31.

In this stage, the other scanning lines GL2, GL3, . . . are all set to −15 V. On the rows of the scanning lines GL2, GL3, . . ., the second TFT elements 2, 2, . . . are put in the on (conductive) state, while the first and third TFT elements 1, 1, 1, . . . and 3, 3, 3, . . . are put in the off (non-conductive) state. Therefore, the electric charges accumulated in the memory capacitance Cm move to the pixel capacitance Cp, and the liquid crystals change their alignment state according to the change in voltage.

These operations were executed sequentially on all the scanning lines GL1, GL2, GL3, In other words, all the scanning lines GL1, GL2, GL3, . . . were sequentially scanned.

Through these operations, the unselected scanning lines consistently have a voltage of −15 V. Accordingly, only the second TFT element 2 is in the on (conductive) state. Therefore, the electric charges in the memory capacitance Cm moved to the pixel capacitance Cp that already had an electric potential equal to that of the opposite electrode 31 due to the discharge via the third TFT element 3 throughout the entire unselected period, consequently changing the alignment state of the liquid crystals according to the change in voltage. Eventually, a balanced state was established when the voltage of the memory capacitance Cm and the voltage of the pixel capacitance Cp became equal to each other and the liquid crystal response was completed. In this stage, the alignment state of the liquid crystals was uniquely determined only by the signal voltage Vs independently of the alignment state of the liquid crystals in the previous frame stage.

Figure 3:
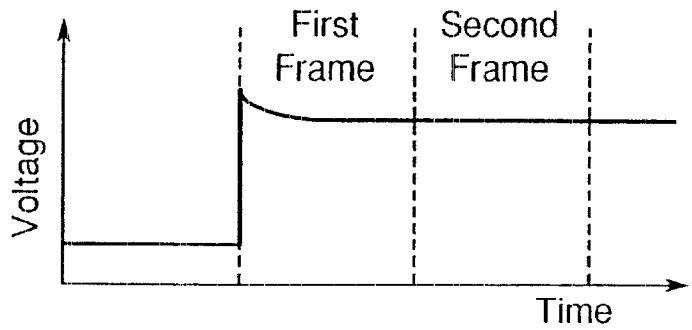
FIG. 3 is a graph showing a time-to-liquid crystal application voltage characteristic when the display of white color is changed to the display of black color in the first embodiment.
Figure 4:
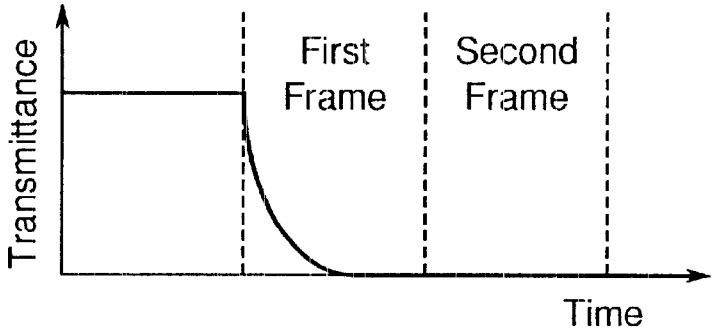
FIG. 4 is a graph showing a time-to-transmittance characteristic when the display of white color is changed to the display of black color in the first embodiment.
Figure 16:
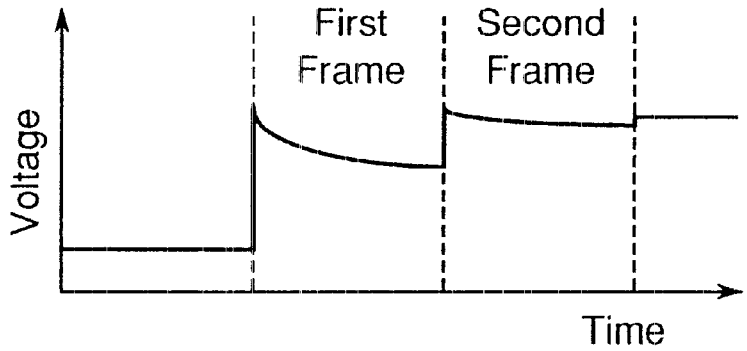
Fig.16 PRIOR ART
FIG. 16 is a graph showing a time-to-liquid crystal application voltage characteristic when the display of white color is changed to the display of black color in the conventional liquid crystal display device.
Figure 17:
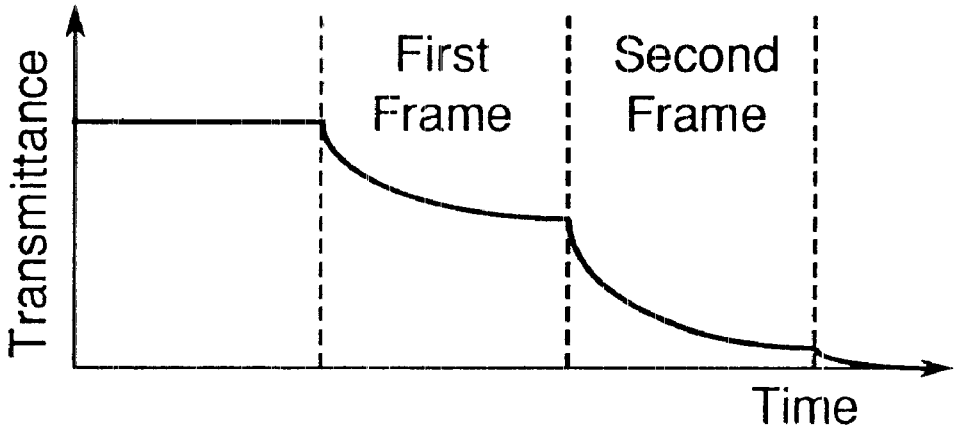
Fig.17 PRIOR ART
FIG. 17 is a graph showing a time-to-transmittance characteristic when the display of white color is changed to the display of black color in the conventional liquid crystal display device.

When the display is changed from the display of white color to the display of black color, a change in liquid crystal application voltage with respect to a lapse of time is shown in FIG. 3, and a change in transmittance of the liquid crystals with respect to a lapse of time is shown in FIG. 4. As clearly indicated by a comparison of FIGS. 3 and 4 that show the characteristics of the first embodiment with FIGS. 16 and 17 that show the characteristics of the conventional liquid crystal display device, a liquid crystal application voltage and transmittance that were not influenced by the previous frame were able to be obtained and the afterimage was able to be reduced according to the first embodiment. In other words, according to the present first embodiment, a video image that was not influenced by the previous frame at all was able to be displayed every frame and the conventionally observed afterimage was able to be removed even when the video image rapidly changed.

The quartz glass was used for the TFT substrate 20 in the first embodiment. However, without being limited to this, silicon wafer, another glass or the like may also be used.

The first, second and third TFT elements 1, 2 and 3 were formed of the high-temperature polysilicon in the first embodiment. However, without being limited to this, the TFT elements can be formed of crystalline silicon, low-temperature polysilicon or the like.

The TN mode liquid crystals were used in the first embodiment. However, without being limited to this, a variety of modes of liquid crystals accompanying a change in dielectric constant and a change n polarizability can be used.

Second Embodiment

Figure 5:
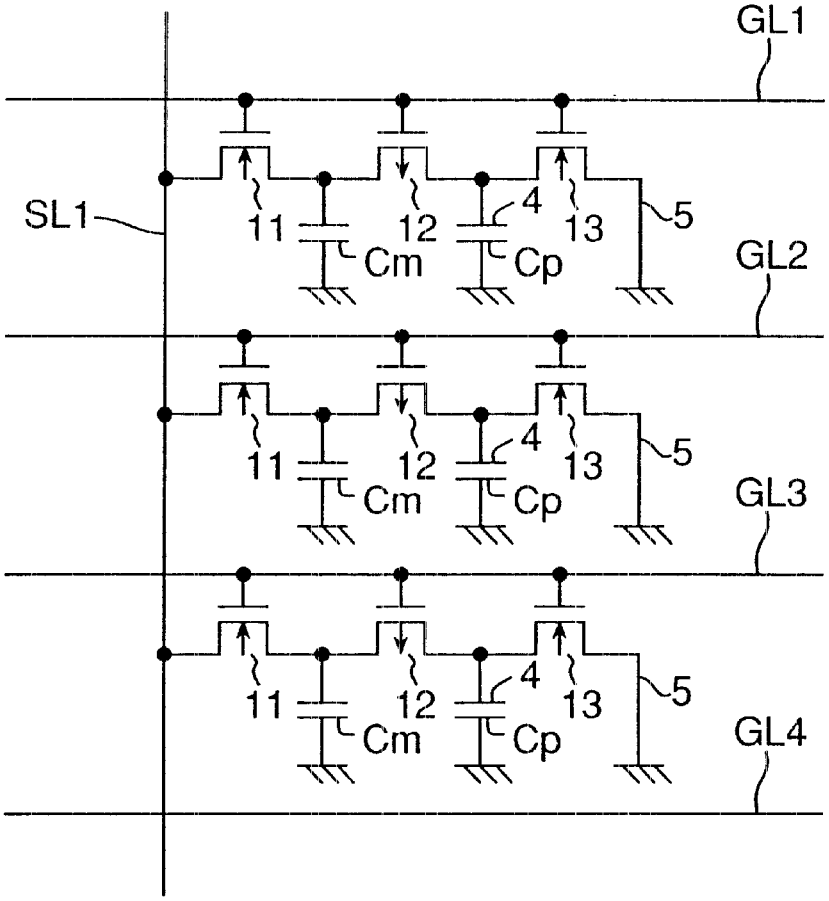
FIG. 5 is an equivalent circuit diagram of a second embodiment of the present invention.

As shown in FIG. 5, the present second embodiment differs from the first embodiment shown in FIG. 2 only in that first and third TFT elements 11 and 13 are each constructed of an enhancement type p-type MOS and a second TFT element 12 is constructed of an enhancement type n-type MOS. In FIG. 5, the components identical to the components of the first embodiment of FIG. 2 are denoted by the same reference numerals with no description provided for them.

When selecting one of the scanning lines GL1, GL2, GL3, . . . , the selected scanning line is made to have a voltage of −15 V, the unselected scanning lines are all made to have a voltage of +15 V, and the signal voltage is made same as that of the first embodiment.

Even in this case, a liquid crystal alignment state that was uniquely determined only by the signal voltage was able to be obtained independently of the liquid crystal alignment state in the previous frame stage.

Therefore, even when the video image is rapidly changed, a video image that was not influenced by the previous frame at all was able to be displayed and the conventional after-image was able to be significantly improved.

Third Embodiment

Figure 6:
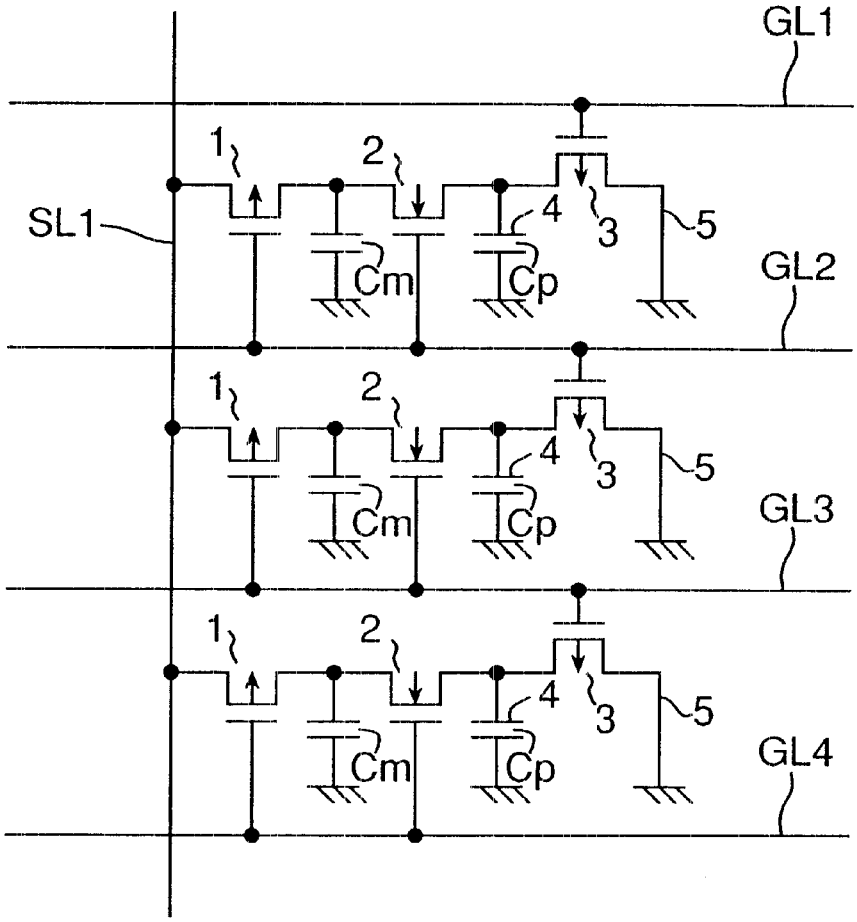
FIG. 6 is an equivalent circuit diagram of a third embodiment of the present invention.

FIG. 6 is an equivalent circuit diagram of the present third embodiment. In this equivalent circuit, the components identical to the components of the first embodiment shown in FIG. 2 are denoted by the same reference numerals with no description provided for them, and only the different components will be described below. In the present third embodiment, the way of connection of the gate electrodes of the first, second and third TFT elements 1, 2 and 3 with the scanning lines GL1, GL2, GL3, . . . is different from that of the first embodiment shown in FIG. 2.

For example, at the intersection of the signal line S1 and the scanning line GL1, the gate electrodes of the first and second TFT elements 1 and 2 are connected to the scanning line GL2, while the gate electrode of the third TFT element 3 is connected to the scanning line GL1. Likewise, at the intersections of the signal lines S1, . . . and the scanning lines GL2, GL3, . . . , the gate electrodes of the first and second TFT elements 1 and 2 are connected to the downside scanning line GL in FIG. 6, while the gate electrode of the third TFT element 3 is connected to the upside scanning line GL.

A driving procedure will be described next. When applying the signal voltage Vs to the specified memory capacitance Cm, two scanning lines GL located before and behind the memory capacitance Cm in the scanning direction are selected and made to have a voltage of +15 , and the other scanning lines GL are made to have a voltage of −15. Then, in regard to the scanning direction of the scanning lines GL1, GL2, . . . , the scanning is executed from the upside scanning line GL to the downside scanning line GL in FIG. 6.

For the sake of explanation, it is now assumed that the pixel of the first row is selected so as to make the scanning lines GL1 and GL2 have a voltage of +15 and make the other scanning lines GL3 and GL4 have a voltage of −15 and then the pixel of the second row is selected so as to make the scanning lines GL2 and GL3 have a voltage of +15 and make the other scanning lines GL1, GL4, . . . have a voltage of −15. The explanation will be made paying attention to the pixel of the second row.

While the pixel of the first row is selected, then the scanning line GL2 relevant to the pixel of the second row has the voltage of +15, and the scanning line GL3 has the voltage of −15.

Accordingly, in the pixel of the second row, the first TFT element 1, which is constructed of the n-type MOS and has the gate electrode connected to the scanning line GL3 having the voltage of −15, is put in the off (non-conductive) state. The third TFT element 3, which is constructed of the n-type MOS and has the gate electrode connected to the scanning line GL2 having the voltage of +15 V, is put in the on (conductive) state. On the other hand, the second TFT element 2, which is constructed of the p-type MOS and has the gate electrode connected to the scanning line GL3 having the voltage of −15, is put in the on (conductive) state.

Accordingly, while the pixel of the first row is selected, the first TFT element 1 is in the off state and the second and third TFT elements 2 and 3 are in the on state in the pixel of the second row. Therefore, the electric charges of the memory capacitance Cm and the pixel capacitance (liquid crystal capacitance) Cp are discharged via the second and third TFT elements 2 and 3 and the wiring line 5.

Next, it is assumed that the pixel of the second row is selected so as to make the scanning lines GL2 and GL3 have the voltage of +15 and make the other scanning lines GL1, GL4, . . . have the voltage of −15.

Then, the first TFT element 1, which is constructed of the n-type MOS of the pixel of the second row and has the gate electrode connected to the scanning line GL3 having the voltage of +15, is put in the on (conductive) state. The third TFT element 3, which is constructed of the n-type MOS of the second row and has the gate electrode connected to the scanning line GL2 having the voltage of +15, is put in the on (conductive) state. The second TFT element 2, which is constructed of the p-type MOS of the pixel of the second row and has the gate electrode connected to the scanning line GL3 having the voltage of +15, is put in the off (non-conductive) state.

Therefore, the signal voltage Vs is applied from the signal line S11 to the memory capacitance Cm via the first TFT element 1 of the pixel of the second row, charging the memory capacitance Cm. Simultaneously with this, the electric charges of the pixel capacitance (liquid crystal capacitance) Cp are discharged via the third TFT element 3 and the wiring line 5, and the electric charges of the pixel capacitance Cp are discharged until the electric potential of the pixel electrode (liquid crystal electrode) 4 becomes equal to the electric potential of the opposite electrode 31 (see FIG. 1). This discharging has also been executed when the pixel of the first row is selected as described hereinbefore. Therefore, the discharging is to be executed two times in total, allowing the discharging to be completely achieved. In particular, if it is tried to increase the aperture rate by reducing in size the second and third TFT elements 2 and 3, then the discharging capabilities of the second and third TFT elements 2 and 3 can be compensated for.

Next, assuming that the pixel of the third row is selected, then the scanning line GL2 relevant to the pixel of the second row comes to have a voltage of −15, while the scanning line GL3 comes to have a voltage of +15.

Therefore, in the pixel of the second row, the first TFT element 1 which is constructed of the n-type MOS and has the gate electrode connected to the scanning line GL3 having the voltage of +15, is put in the on (conductive) state. The third TFT element 3, which is constructed of the n-type MOS and has the gate electrode connected to the scanning line GL2 having the voltage of −15, is put in the off (non-conductive) state. The second TFT element 2, which is constructed of the p-type MOS and has the gate electrode connected to the scanning line GL3 having the voltage of +15, is put in the off (non-conductive) state.

Therefore, in the pixel of the second row, the signal voltage Vs is applied from the signal line S11 to the memory capacitance Cm via the first TFT element 1, and the memory capacitance Cm is charged up to the signal voltage Vs. The charging of the memory capacitance Cm with electric charges has already been executed at the time of selecting the pixel of the second row, as described hereinbefore.

Eventually, the operation of charging the memory capacitance Cm has been executed two times in total. Therefore, the charging of the memory capacitance Cm can be more reliably executed. In particular, when it is tried to increase the aperture rate by reducing in size the first TFT element 1, the charging capability of the first TFT element 1 can be compensated for.

Next, assuming that the pixel of the fourth row (not shown) is selected, then the scanning lines GL2 and GL3 relevant to the pixel of the second row come to have a voltage of −15.

Then, the second TFT element 2, which is related to the pixel of the second row and has the gate electrode connected to the scanning line GL3 having the voltage of −15, is put in the on (conductive) state. On the other hand, the first TFT element 1, which has the gate electrode connected to the scanning line GL3 having the voltage of −15 V, is put in the off (non-conductive) state. The third TFT element 3, which has the gate electrode connected to the scanning line GL2 having the voltage of +15, is also put in the off (non-conductive) state. Therefore, the electric charges accumulated in the memory capacitance Cm move to the pixel capacitance Cp, and the liquid crystals change their alignment state according to a change in voltage.

These operations were sequentially executed by selecting every adjacent two scanning lines of all the scanning lines GL1, GL2, GL3, . . . In other words, all the scanning lines GL1, GL2, GL3, . . . were scanned every adjacent two scanning lines.

Through this operation, the unselected scanning line consistently has a voltage of −15, and therefore, only the second TFT element 2 is in the on (conductive) state in the pixels of the rows located before and behind the selected row but one. Therefore, the electric charges in the memory capacitance Cm moved throughout the entire unselected period to the pixel capacitance Cp that already had an electric potential equal to that of the opposite electrode 31 due to the discharge via the third TFT element 3, consequently changing the alignment state of the liquid crystals according to a change in voltage. Eventually, a balanced state was established when the voltage of the memory capacitance Cm and the voltage of the pixel capacitance Cp became equal to each other and the liquid crystal response was completed. In this stage, the alignment state of the liquid crystals was uniquely determined only by the signal voltage Vs independently of the liquid crystal alignment state in the previous frame stage. Therefore, a liquid crystal application voltage and transmittance that were not influenced by the previous frame was able to be obtained, and the afterimage was able to be reduced. In other words, according to the present third embodiment, a video image that was not influenced by the previous frame at all was able to be displayed every frame and the conventionally observed afterimage was able to be removed even when the video image is rapidly changed.

According to the present third embodiment, the scanning is executed by selecting the mutually adjoining two scanning lines GL. Therefore, the operation of charging the memory capacitance Cm with electric charges is executed eventually two times, allowing the memory capacitance Cm to be reliably charged. Therefore, even when the memory capacitance Cm cannot be sufficiently charged only at a time, the memory capacitance Cm can be more reliably charged according to the driving method of the third embodiment. In particular, this driving method is effective for compensating for the charging capability and discharging capability of the TFT element when the aperture rate is increased by reducing in size the TFT element.

Fourth Embodiment

Figure 7:
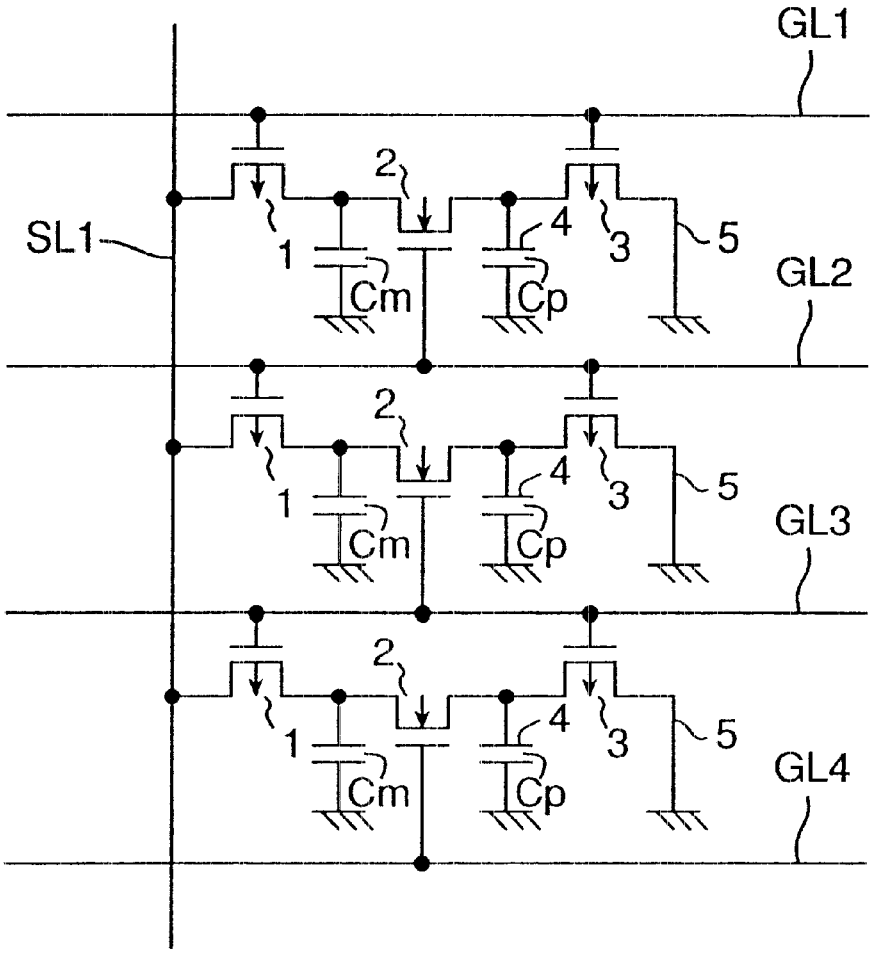
FIG. 7 is an equivalent circuit diagram of a fourth embodiment of the present invention.

FIG. 7 is an equivalent circuit diagram of the present fourth embodiment. In this equivalent circuit diagram, the components identical to the components of the third embodiment of FIG. 6 are denoted by the same reference numerals with no description provided for them, and only the different components will be described below. In the aforementioned third embodiment, the gate electrode of the first TFT element 1 of the pixel of each row is connected to the downside scanning line GL in FIG. 6. In the fourth embodiment, the gate electrode of the first TFT element 1 of the pixel of each row is connected to the upside scanning line GL in FIG. 7. The third and fourth embodiments differ from each other only in this point.

The driving method is to select adjacent two scanning lines GL so as to apply a voltage of +15 to the selected scanning lines GL and apply a voltage of −15 to the other unselected scanning lines GL. The operation slightly differs in terms of transition, however, the operation related to the selected and unselected rows is the same as those of the third embodiment.

Fifth Embodiment

Figure 8:
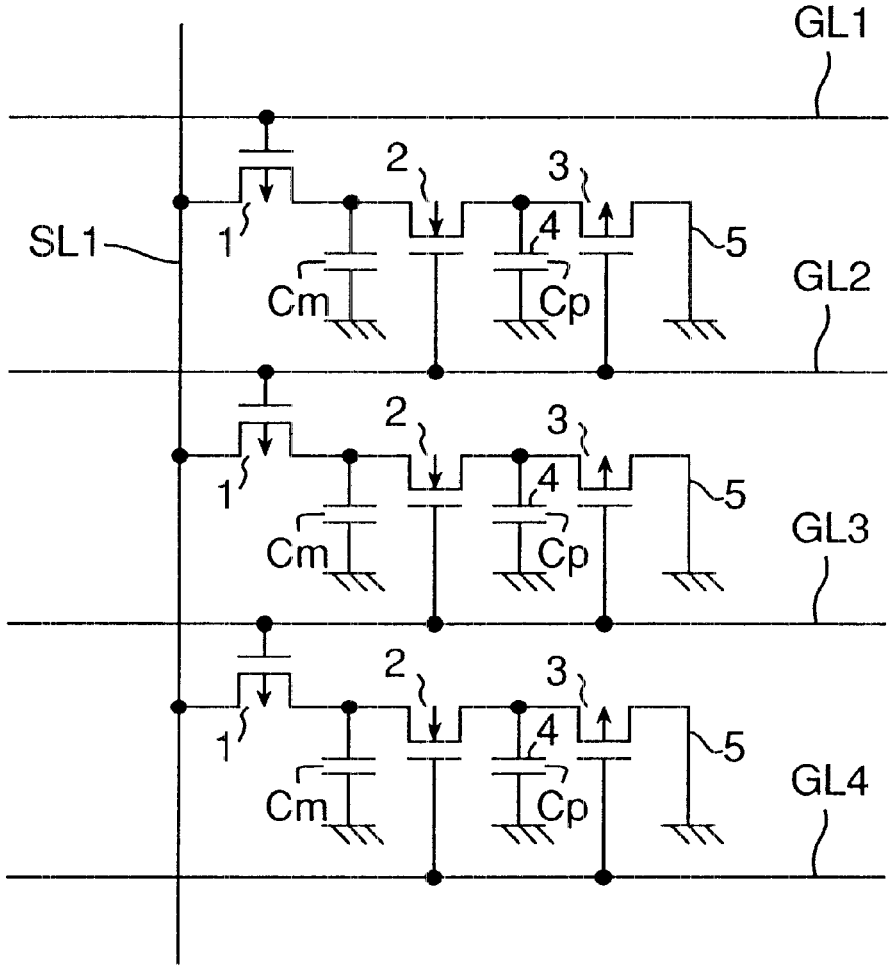
FIG. 8 is an equivalent circuit diagram of a fifth embodiment of the present invention.

FIG. 8 is an equivalent circuit diagram of the present fifth embodiment. In this equivalent circuit, the components identical to the components of the fourth embodiment shown in FIG. 7 are denoted by the same reference numerals with no description provided for them, and only the different components will be described below. In the aforementioned fourth embodiment, the gate electrode of the third TFT element 3 of the pixel of each row is connected to the upside scanning line GL in FIG. 7. In the fifth embodiment, the gate electrode of the third TFT element 3 of the pixel of each row is connected to the downside scanning line GL in FIG. 8. The fourth and fifth embodiments differ from each other only in this point.

The driving method is to select adjacent two scanning lines GL so as to apply a voltage of +15 to the selected scanning lines GL and apply a voltage of −15 to the other unselected scanning lines GL. The operation slightly differs in terms of transition, however, the operation related to the selected and unselected rows is the same as those of the fourth embodiment.

Sixth Embodiment

Figure 9:
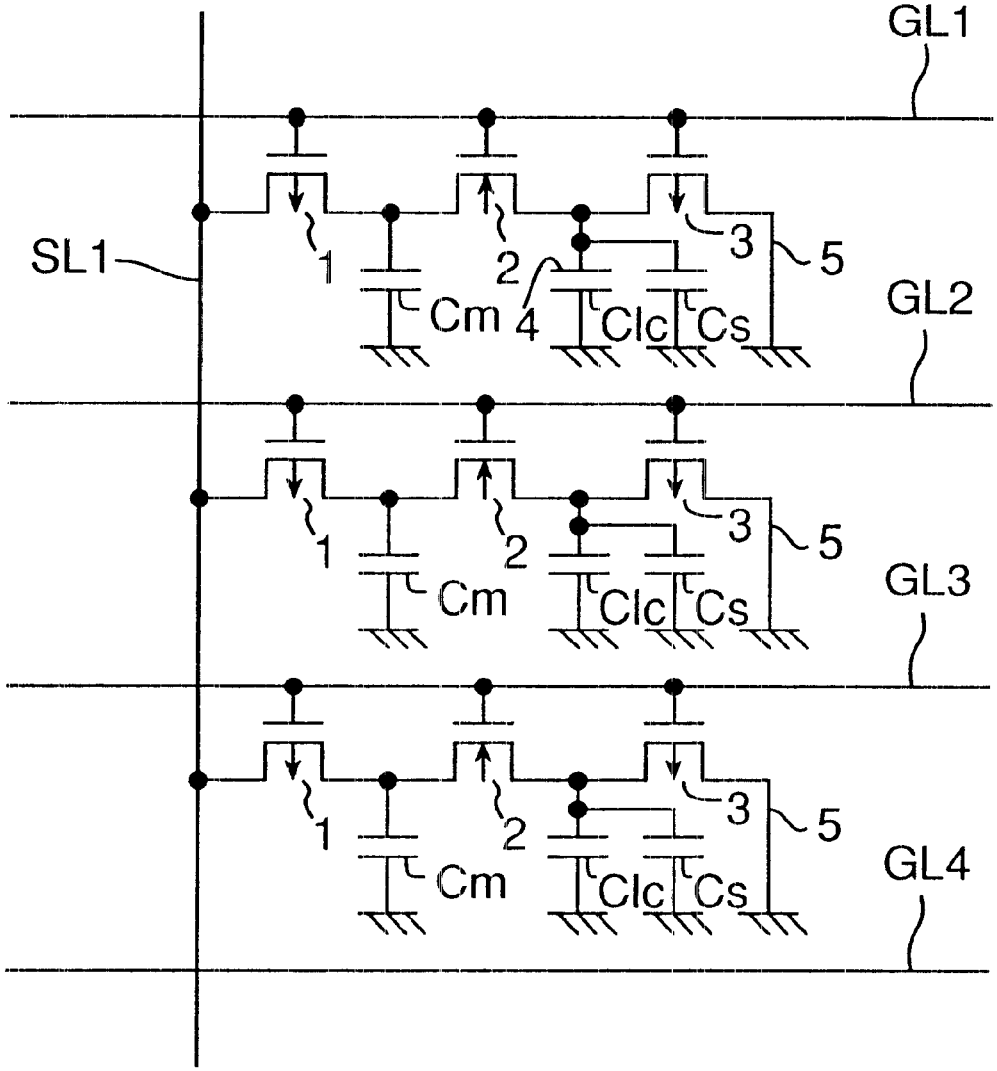
FIG. 9 is an equivalent circuit diagram of a sixth embodiment of the present invention.

FIG. 9 shows an equivalent circuit diagram of the present sixth embodiment. According to the first embodiment shown in FIG. 2, the pixel capacitance Cp is provided by the liquid crystal capacitance itself. In contrast to this, according to the sixth embodiment shown in FIG. 9, the pixel capacitance Cp was provided by a parallel connection of a liquid crystal capacitance Clc and an auxiliary capacitance Cs. In other words, the above arrangement was made to satisfy the equation:

$$\text{Pixel Capacitance } Cp = \text{Liquid Crystal Capacitance } Clc + \text{Auxiliary Capacitance } Cs.$$

The auxiliary capacitance Cs was set to 0.2 pF. The memory capacitance Cm was designed to have a capacitance of 0.5 pF.

The liquid crystal capacitance Clc at the time of the display of white color was 0.065 pF, while the liquid crystal capacitance Clc at the time of the display of black color was 0.12 pF. The signal voltage was set on the basis of the fact that electric charges are retained, according to the following equation:

$$Cm \times Vs = (Cm + Clc + Cs) \times Vlc$$

where Cm: memory capacitance,

Vs: signal voltage,

Clc: liquid crystal capacitance,

Cs: auxiliary capacitance, and

Vlc: liquid crystal application voltage.

In this case, the signal voltage was set as follows.

| | Display of White Color | Display of Black Color |
|---|---|---|
| Signal Voltage Vs | 2.68 V | 7.74 V |
| liquid crystal application voltage Vlc | 1.75 V | 4.72 V |

A fluctuation in liquid crystal application voltage was able to be suppressed when the parasitic capacitance of the drain of the second TFT element 2 and the scanning line was large.

Figure 10:
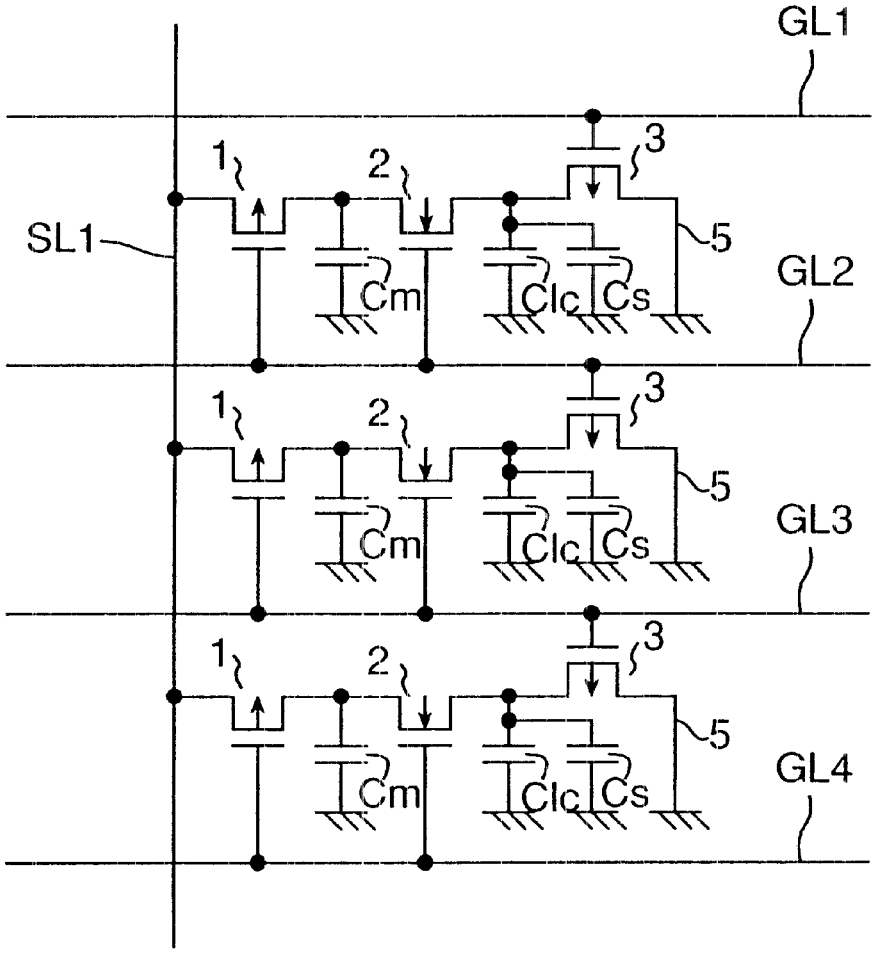
FIG. 10 is an equivalent circuit diagram of a modification example of the sixth embodiment of the present invention.
Figure 11:
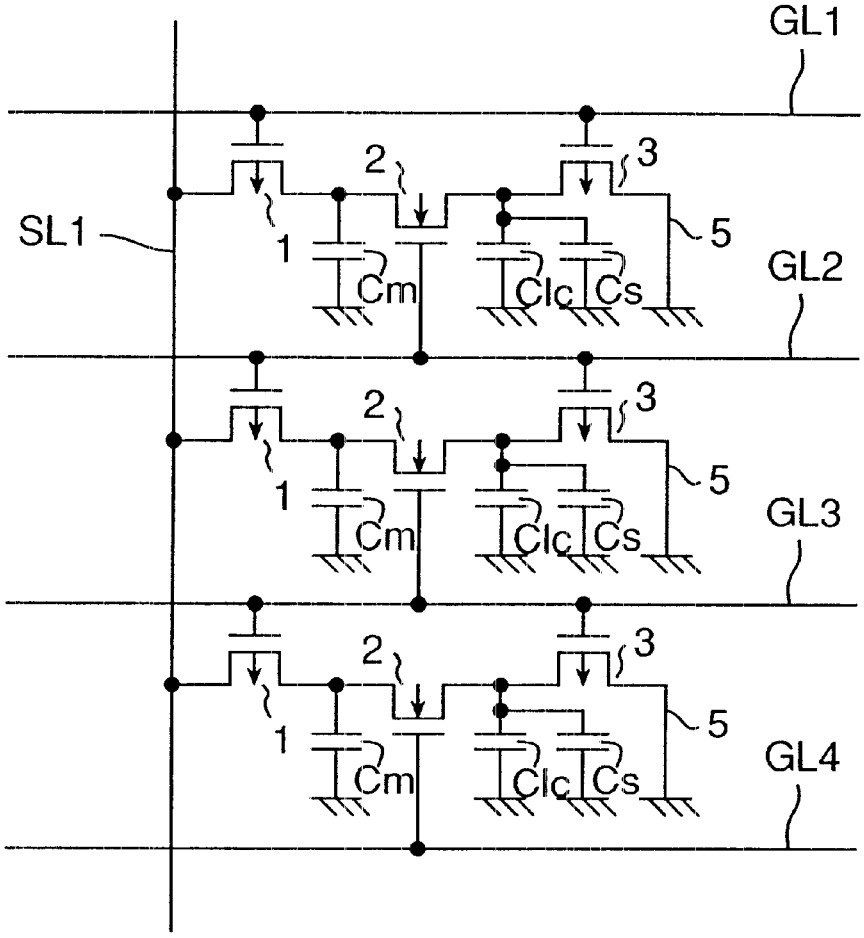
FIG. 11 is an equivalent circuit diagram of a modification example of the sixth embodiment of the present invention.
Figure 12:
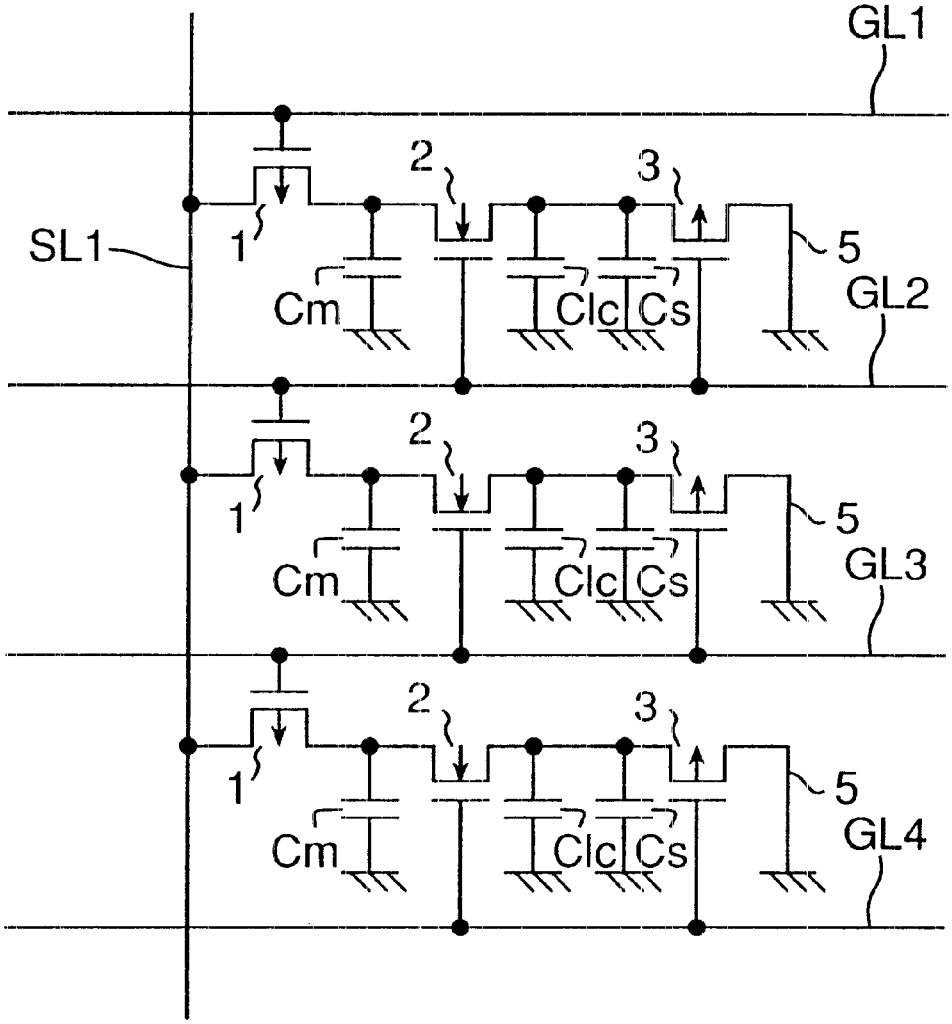
FIG. 12 is an equivalent circuit diagram of a modification example of the sixth embodiment of the present invention.
Figure 13:
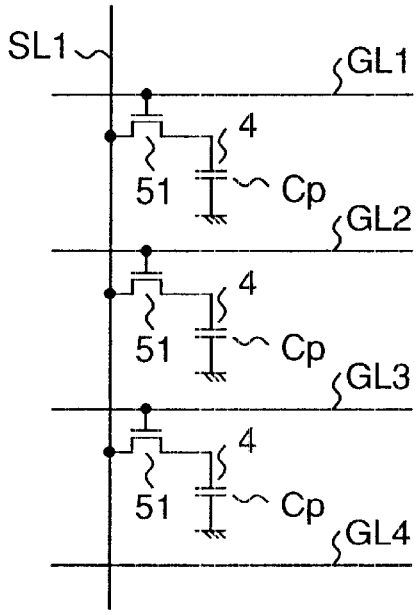
Fig.13 PRIOR ART
FIG. 13 is an equivalent circuit diagram of the essential part of a conventional liquid crystal display device.

According to the modification example shown in FIG. 10, the pixel capacitance Cp of the third embodiment shown in FIG. 6 is comprised of the liquid crystal capacitance Clc and the auxiliary capacitance Cs. According to the modification example shown in FIG. 11, the pixel capacitance Cp of the fourth embodiment shown in FIG. 7 is comprised of the liquid crystal capacitance Clc and the auxiliary capacitance Cs. According to the modification example shown in FIG. 12, the pixel capacitance Cp of the fifth embodiment shown in FIG. 8 is comprised of the liquid crystal capacitance Clc and the auxiliary capacitance Cs. According to these modification examples, the effect of the auxiliary capacitance Cs was able to be obtained similarly to the sixth embodiment.

Seventh Embodiment

The present seventh embodiment employs the same circuit construction as that of the first embodiment shown in FIG. 2, however, it has a varied driving method to be executed by a scanning control circuit (not shown). The driving method will be described below with reference to FIG. 2.

When scanning the scanning lines GL1, GL2, one of the scanning lines GL1, GL2, . . . was selected and made to have a voltage of +15, and all the other scanning lines GL were made to have a voltage of 0 V. By thus sequentially scanning all the scanning lines GL1, GL2, . . . a specified signal voltage Vs was able to be written into the memory capacitance Cm of all the pixels, and the pixel capacitance Cp was able to be simultaneously discharged.

Subsequently, all the scanning lines GL1, GL2, . . . were concurrently made to have a voltage of −15. Then, all the second TFT elements 2 were put in the on state, and all the first and third TFT elements 1 and 3 were put in the off state. Consequently, in all the pixels, the pixel capacitances (liquid crystal capacitances) Cp were able to simultaneously respond.

Through these operations, the writing of the signal voltage Vs that was not influenced by the previous frame at all and the simultaneous response of all the pixels were able to be made compatible.

According to the present seventh embodiment, the scanning lines GL1, GL2, . . . are driven by three values, and therefore, the first, second and third TFT elements 1, 2 and 3 of both the n-type MOS and the p-type MOS are required to be made simultaneously non-conductive at a voltage of 0 V. Therefore, the first, second and third TFT elements 1, 2 and 3 are constructed of an enhancement type MOS. The operation of making non-conductive at 0 V is difficult for the depletion type MOS.

With regard to the first through sixth embodiments, the enhancement type MOS is not always required to be employed. However, in order to effectively prevent the leak (off current) during the unselected stage, the enhancement type MOS is appropriate.

Eighth Embodiment

The present eighth embodiment employs the same circuit construction as that of the second embodiment shown in FIG. 5. However, it has a varied driving method to be executed by a scanning control circuit (not shown). The driving method will be described with reference to FIG. 5.

When scanning the scanning lines GL1, GL2, c:one of the scanning lines GL1, GL2, . . . was selected and made to have a voltage of −15, and all the other scanning lines GL were made to have a voltage of 0 V. By thus sequentially scanning all the scanning lines GL1, GL2, . . . a specified signal voltage Vs was able to be written into the memory capacitance Cm of all the pixels, and the pixel capacitance Cp was able to be simultaneously discharged.

Subsequently, all the scanning lines GL1, GL2, were concurrently made to have a voltage of +15. Then, all the second TFT elements 2 were put in the on state, and all the first and third TFT elements 11 and 13 were put in the off state. Consequently, in all the pixels, the pixel capacitances (liquid crystal capacitances) Cp were able to simultaneously respond.

Through these operations, the writing of the signal voltage Vs that was not influenced by the previous frame at all and the simultaneous response of all the pixels were able to be made compatible.

According to the present eighth embodiment driven by three values, the first, second and third TFT elements 11, 12 and 13 are constructed of an enhancement type MOS. With this arrangement, the TFT elements 11, 12 and 13 of both the p-type and n-type MOS elements are made simultaneously non-conductive at a voltage of 0 V.

Ninth Embodiment

On the bases of the liquid crystal display devices that were obtained according to the first through eighth embodiments, devices having no color filter of the opposite substrate 30 (i.e., a monochrome liquid crystal display devices) were fabricated. Then, each of these liquid crystal display devices was driven by the field-sequential driving system for time-sharingly dividing the three primary colors. According to this liquid crystal display device, a display that was influenced by nothing on the previous frame was fabricated. Therefore, a very high color purity was able to obtained. In other words, a liquid crystal display device of the field-sequential driving system having very high color purity was obtained.

Tenth Embodiment

In the liquid crystal display devices that were able to be obtained according to the first through ninth embodiments, the writing of all the pixels was completed within a time of 8.35 ms at the start of one frame duration, and a back light was lit within a time of 2.00 ms at the end of one frame duration.

It is known that a pulse lighting type display similar to the CRT (Cathode Ray Tube) can be obtained and the quality is improved for motion picture display when the back light is lit during a certain period as described above.

As described above, by applying the back light lighting system to the liquid crystal display device that does not depend on the previous frame at all, a liquid crystal display device excellent in displaying a motion picture is provided.

As is apparent from the above, according to the liquid crystal display device of the present invention, a video image that is not influenced by the previous frame at all can be displayed every frame by removing the afterimage attributed to the change in dielectric constant at the time of response of the liquid crystals, and the image quality can be improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An active matrix type liquid crystal display device comprising:

a TFT substrate on which a plurality of scanning lines and a plurality of signal lines are arranged so as to intersect each other and which has a pixel electrode, a memory capacitance and first, second and third TFT elements provided at each intersection of the scanning lines and the signal lines;

an opposite substrate having an opposite electrode; and a liquid crystal layer held between the TFT substrate and the opposite substrate, gate electrodes of the first, second and third TFT elements being connected to the scanning lines, the first TFT element controlled to determine whether or not electric charges are supplied from the signal line to the memory capacitance, the second TFT element controlled to determine whether or not the electric charges stored in the memory capacitance are supplied to the pixel electrode, the third TFT element controlled to determine whether or not the pixel electrode is connected to a wiring line of a specified voltage, and the first, second and third TFT elements being comprised of one n-type MOS element and two p-type MOS elements or constructed of one p-type MOS element and two n-type MOS elements.

2. A liquid crystal display device as claimed in claim 1, wherein the gate electrodes of the first TFT elements existing on an identical row are all connected to an identical scanning line, the gate electrodes of the second TFT elements existing on an identical row are all connected to an identical scanning line, and the gate electrodes of the third TFT elements existing on an identical row are all connected to an identical scanning line.

3. A liquid crystal display device as claimed in claim 1, wherein, during a period in which the scanning lines are not selected, the memory capacitance and the pixel electrode are put in a conductive state by the second TFT element, the memory capacitance and the signal line are in a non-conductive state by the first TFT element, and the pixel electrode and the wiring line are put in a non-conductive state by the third TFT element.

4. A liquid crystal display device as claimed in claim 1, wherein a gate potential is applied from an identical scanning line to the gate electrodes of all the first, second and third TFT elements that control an identical pixel.

5. A liquid crystal display device as claimed in claim 1, wherein, among the first, second and third TFT elements that control an identical pixel, a gate potential is applied from an identical scanning line to the gate electrodes of the first and second TFT elements and a gate potential is applied to the gate electrode of the third TFT element from a scanning line located before or behind the above scanning line in the scanning direction.

6. A liquid crystal display device as claimed in claim 1, wherein, among the first, second and third TFT elements that control an identical pixel, a gate potential is applied from an identical scanning line to the gate electrodes of the first and third TFT elements and a gate potential is applied to the gate electrode of the second TFT element from a scanning line located before or behind the above scanning line in the scanning direction.

7. A liquid crystal display device as claimed in claim 1, wherein, among the first, second and third TFT elements that control an identical pixel, a gate potential is applied from an identical scanning line to the gate electrode of the first TFT element and a gate potential is applied to the gate electrodes of the second and third TFT elements from a scanning line located before or behind the above scanning line in the scanning direction.

8. A liquid crystal display device as claimed in claim 1, wherein a plurality of scanning lines are simultaneously selected.

9. A liquid crystal display device as claimed in claim 1, wherein only the scanning line of the pixel to the memory capacitance of which a signal voltage is applied is controlled to have a high potential, the other scanning lines are controlled to have a low potential, the first and third TFT elements are comprised of an n-type MOS transistor and the second TFT element is comprised of a p-type MOS transistor.

10. A liquid crystal display device as claimed in claim 1, wherein only the scanning line of the pixel to the memory capacitance of which a signal voltage is applied is controlled to have a low potential, the other scanning lines are controlled to have a high voltage, the first and third TFT elements are comprised of a p-type MOS transistor and the second TFT element is comprised of an n-type MOS transistor.

11. A liquid crystal display device as claimed in claim 1, wherein the pixel electrode is connected to the wiring line that has a potential identical to the potential of the opposite electrode by the third TFT element.

12. A liquid crystal display device as claimed in claim 1, wherein, assuming that a memory capacitance is Cm, a pixel capacitance when a liquid crystal response is completed is Cp, a signal voltage is Vs and a liquid crystal application voltage when the liquid crystal response is completed is Vlc, then there holds a relation:

$$Cm \times Vs = (Cm + Cp) \times Vlc.$$

13. A liquid crystal display device as claimed in claim 1, wherein an auxiliary capacitance is connected parallel with a liquid crystal capacitance, and assuming that a pixel capacitance when a liquid crystal response is completed is Cp, the liquid crystal capacitance is Clc and an auxiliary capacitance is Cs, then there holds a relation:

$$Cp = Clc + Cs.$$

14. A liquid crystal display device as claimed in claim 1, wherein the first, second and third TFT elements are all comprised of an enhancement type MOS transistor.

15. A liquid crystal display device as claimed in claim 1, wherein the first and third TFT elements are comprised of an n-type MOS transistor, the second TFT element is comprised of a p-type MOS transistor, a positive voltage is applied to the scanning line of the pixel to which the signal voltage is applied, an approximately zero volt is applied to the other scanning lines and a negative voltage is simultaneously applied to all the scanning lines after completing the selection of all the scanning lines.

16. A liquid crystal display device as claimed in claim 1, wherein the first and third TFT elements are comprised of a p-type MOS transistor, the second TFT element is comprised of an n-type MOS transistor, a negative voltage is applied to the scanning line of the pixel to which the signal voltage is applied, an approximately zero volt is applied to the other scanning lines and a positive voltage is simultaneously applied to all the scanning lines after completing the selection of all the scanning lines.

17. A liquid crystal display device as claimed in claim 1, wherein multicolor display is provided by a field-sequential system for displaying three primary colors in a time-sharing manner.

18. A liquid crystal display device as claimed in claim 1, wherein a light source is allowed to emit light only in a part of one frame period or made to have light from the light source obstructed in a part of one frame period.

* * * * *